US005356023A

United States Patent [19]

Krupa

[11] Patent Number: 5,356,023

[45] Date of Patent: Oct. 18, 1994

[54] ROSE BOX WITH INTERCHANGEABLE LID AND BASE

[75] Inventor: Calvin S. Krupa, Medina, Minn.

[73] Assignee: Ultra Pac, Inc., Rogers, Minn.

[21] Appl. No.: 147,031

[22] Filed: Nov. 4, 1993

[51] Int. Cl.[5] ..... B65D 1/00

[52] U.S. Cl. ..... 220/4.24; 220/4.21

[58] Field of Search ..... 220/4.21, 4.24; 206/470

[56] References Cited

U.S. PATENT DOCUMENTS

| | | | |
|---|---|---|---|
| 2,289,037 | 7/1942 | Poglein | 220/4.24 X |
| 2,999,611 | 9/1961 | Paulson | 220/4.24 |
| 3,145,870 | 8/1964 | Lockwood | 220/4.24 |
| 3,565,146 | 2/1971 | Arnolds | 220/4.24 X |
| 3,620,403 | 11/1971 | Rump | 220/4.24 |
| 3,902,540 | 9/1975 | Commisso | 150/0.5 |
| 3,933,295 | 1/1976 | Congleton | 220/4.24 X |
| 4,006,558 | 2/1977 | Neddo et al. | 47/77 |
| 4,159,062 | 6/1979 | Levenhagen | 220/4 B |
| 4,219,693 | 8/1980 | French | 220/4.24 X |
| 4,294,371 | 10/1981 | Davis | 220/4 E |
| 4,494,650 | 1/1985 | Cullen | 220/4.21 X |
| 4,838,444 | 6/1989 | Bitel | 220/4 E |
| 4,974,738 | 12/1990 | Kidd et al. | 220/4.24 |
| 5,046,659 | 9/1991 | Warburton | 229/2.5 |

*Primary Examiner*—Steven M. Pollard
*Attorney, Agent, or Firm*—Haugen and Nikolai

[57] ABSTRACT

A container designed for protecting and displaying flowers. The container comprising interchangeable, rectangular lid and base components. The components are preferably made of plastic, such as polyethylene tetrafluoride. Each component has two outwardly extending rims. One rim has a male protrusion and the other has a female recess. In operation, the two sides of opposing lid and base components form a loose joint. Each component also has two end portions. Each end portion has an interlocking lip. The lips extend over halfway across each end portion. Lips on opposing lid and base components are forced past each other to interlock and hold the container together. The components also have a rectangular extension at one end for hanging the container on display or hanging the components in storage.

11 Claims, 2 Drawing Sheets

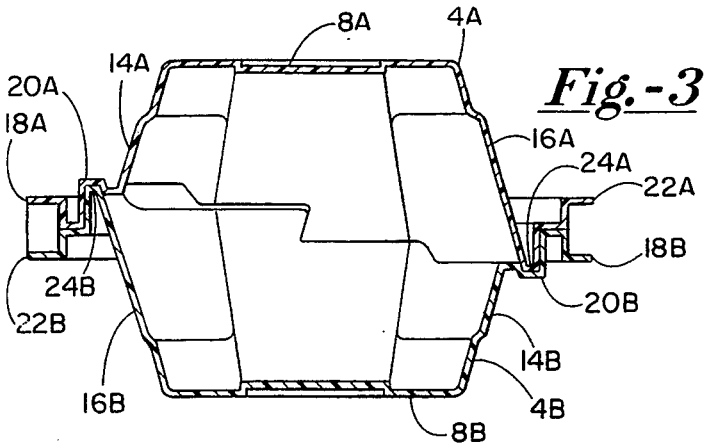
Fig.-3
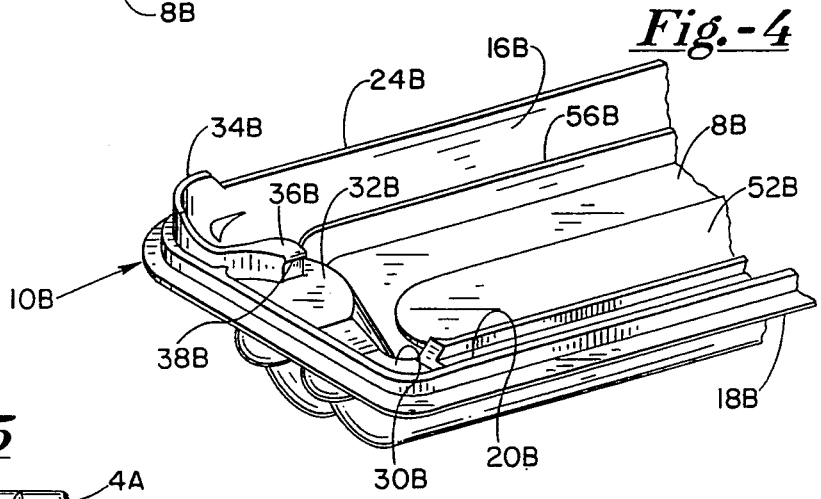
Fig.-4
Fig.-5
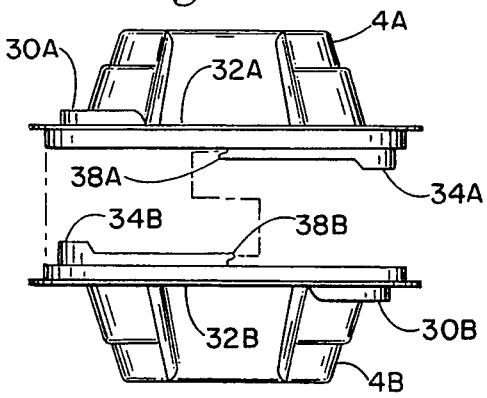
Fig.-6
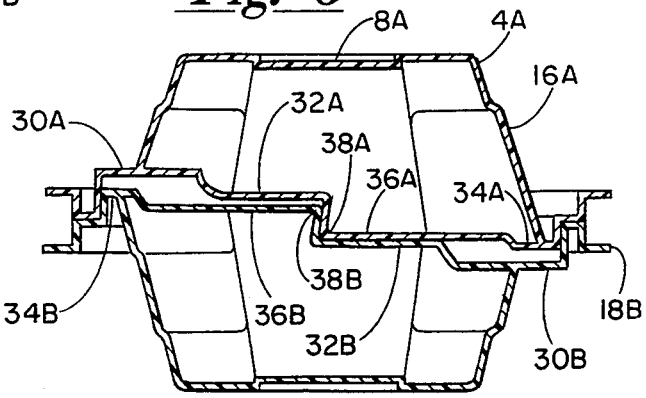

ROSE BOX WITH INTERCHANGEABLE LID AND BASE

BACKGROUND OF THE INVENTION

I. Field of the Invention

The present invention relates generally to containers, and more particularly to flower containers for displaying and protecting cut flowers.

II. Description of the Prior Art

Flowers are pleasing to look at and smell. They bring back fond memories of precious moments and childhood. People often give flowers to someone they care for to show genuine affection. To this end, flowers and stems are cut from their roots and packaged for resale. A package for selling flowers should showcase the beauty of the flower to attract customers. Wilted or damaged flowers are not wanted by customers. Therefore, a package for selling flowers must also protect the flowers from the elements and handling.

The package for selling flowers must be durable, disposable, and inexpensive. In today's marketplace, flowers are sold in a variety of locations including specialty shops, drug stores, retail food outlets and street corners. In the past, flowers have been sold either without a package or wrapped in tissue paper. These techniques give the flower very little, or no, protection and are not suitable for the market channels flowers are sold in today.

Inexpensive, disposable containers for marketing, storing, packaging and serving various foods are well known. These containers commonly use at least two different components. However, this requires the stocking of several non-interchangeable components, taking up a large amount of storage space.

Food containers having interchangeable top and bottom portions have been built in the past. U.S. Pat. No. 4,974,738, issued to Kidd et al., discloses a container having a tray component and an independent cover component. The tray and cover are interchangeable, each providing a laterally extending rim. The rim is divided into two halves, one half interlocking with the second half when the tray and cover components are in a closed position. This provides a very securely locked container and an almost completely sealed compartment for transporting food. Material inside the container of the Kidd et al. patent can be observed through the cover. However, the container of the Kidd et al. patent is more securely locked and sealed than needed for protecting flowers. A flower container must let the flower breathe.

U.S. Pat. No. 2,999,611, issued to Paulson, discloses a rectangular container having interchangeable top and bottom halves. Each section has a continuous main wall and a pair of auxiliary walls at diagonal corners. The auxiliary walls are offset outwardly and extend about half-way around the main wall. A post-like abutment on the inner side of each main wall, at diagonal corners, assists in aligning the sections for assembly. A nib, attached to the main wall, fits into a socket for locking the two sections together. The container of the Paulson patent is not designed for protecting a flower. The overlapping auxiliary walls and the nib & socket arrangement seal the container more tightly than needed or desired for flowers. A flower container needs to breathe so excess moisture can be given off and lack of moisture remedied by surrounding conditions.

U.S. Pat. No. 3,620,403, issued to Rump, discloses a thin-walled thermoplastic container having an identically shaped triangular top and bottom. The top and bottom have an outwardly extending rim with a flanged portion for interlocking with the opposing rim. This container is designed for carrying food, such as pies and cakes. The container is not designed to breathe.

A container for carrying at least one flower and having the capacity to protect and display the flower while allowing the flower to breathe is not shown in the above references.

SUMMARY OF THE INVENTION

The present invention is directed to a container for protecting and displaying at least one flower. The container breathes, giving off excess moisture and allowing surrounding moisture to enter. Packages giving less protection to flowers or not built for displaying flowers can be disposed of and replaced with the present invention.

It is accordingly a principal object of the present invention to provide an improved container.

Another object of the invention is to provide an improved container for at least one flower.

Yet another object of the invention is to provide a flower container that breathes, allowing moisture to pass in and out.

Yet another object of the invention is to provide a flower container having interchangeable lid and base components for easy storage.

Yet another object of the invention is to provide a container for protecting and displaying flowers while allowing moisture to pass in and out.

The foregoing features and advantages of the present invention are attained by providing a plastic container having identically shaped lid and base components. The container is generally rectangular and substantially longer than it is wide. The lid and base components are separable halves held together at opposite ends by interlocking lips. The lid and base components can be made of a clear plastic for displaying the contents. Colored opaque or translucent plastic could also be used.

The components each have two side walls, two end portions and a surface member. The side walls slope away from the surface member and into first and second outwardly extending rims. Each side wall has a ridge or terrace for support and aesthetic purposes.

The first and second outwardly extending rims extend the length of the container. The first outwardly extending rim includes a female recess and the second outwardly extending rim includes a male protrusion. With the lid and base components oppositely disposed, their male and female members cooperate to form loose joints along both rims.

Each component has two end portions. Each end portion has a protruding nub and projecting plateau. The end portions also have recessed areas for accepting the protrusions of an oppositely disposed component. The projecting plateau on the end portions has an interlocking lip attached to it. The interlocking lip extends over halfway across each end portion. Lips on oppositely disposed lid and base components interlock to hold the container together.

Each component also has a rectangular extension on one end. The extension has a recessed area with a hole in it. The hole is for hanging the container on display or for storing the components.

Other objects, features and advantages of the present invention will become apparent to those skilled in the art through the description of the preferred embodiment, claims, and drawings herein wherein like numerals refer to like elements.

BRIEF DESCRIPTION OF THE DRAWINGS

FIG. 3 is a cross sectional view of the container taken along the line 3—3 in FIG. 1.

FIG. 4 is a close-up view of one end portion of the base.

FIG. 5 is an end view showing the lid and base components separated and aligned for joining together.

FIG. 6 is a cross sectional view of one end of the container taken along the line 6—6 in FIG. 1.

DETAILED DESCRIPTION OF THE PREFERRED EMBODIMENT

Figure 1:
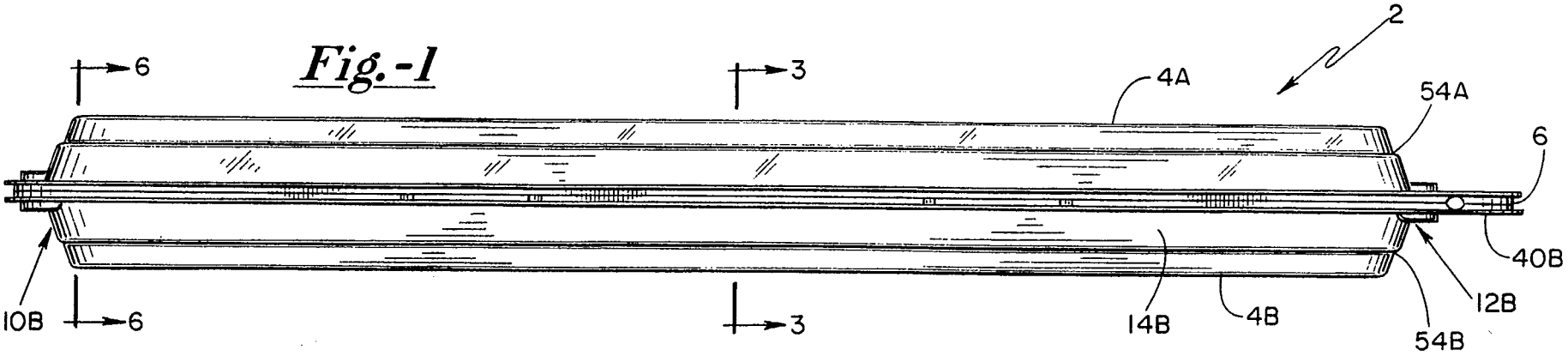
FIG. 1 is a side view showing the lid and base components together, forming the container.

Indicated in FIG. 1, is a flower container 2, having two identically shaped elongated components, one comprising a lid 4A and the other comprising a base 4B. The lid 4A and base 4B components are generally rectangular boxes having one open side each. The components snap together at each end with the open sides facing each other. This forms a rectangular shaped container 2. The container 2 opens along the line marked with numeral 6. Each component, 4A and 4B, is preferably made of plastic such as polyethylene tetrafluoride. The container 2 was built to carry one flower, such as a rose, but the design may be expanded to carry more items.

Figure 2:
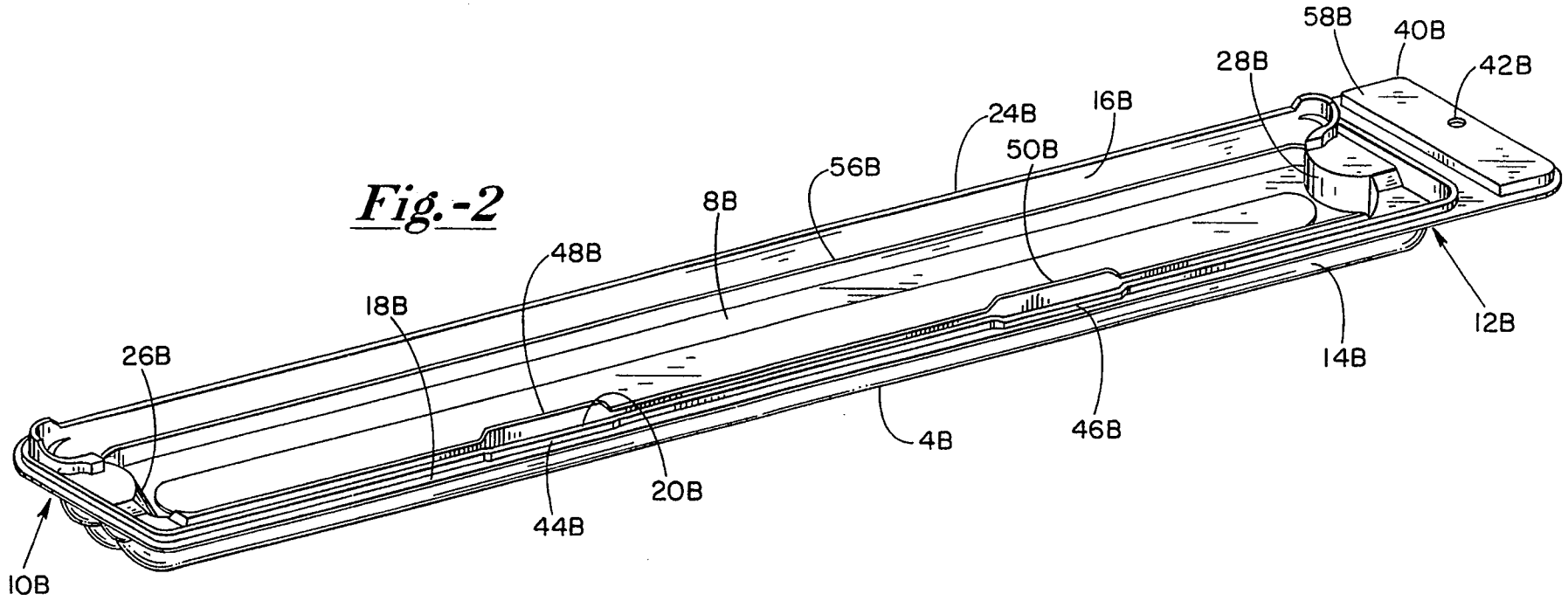
FIG. 2 is a perspective view of the base showing the surface member, two end portions, the male protrusion and the female recess.

As shown in FIGS. 2, 3 and 4, the base 4B has a surface member 8B. Two side walls, 14B and 16B, slope away from the surface member 8B, FIG. 3. The first side wall 14B terminates in a first outwardly extending rim 18B. This first outwardly extending rim 18B includes a female recess 20B along its entire length. The second side wall 16B terminates in a second outwardly extending rim 22B, FIG. 3. This second outwardly extending rim 22B includes a male protrusion 24B along its entire length.

As seen in FIG. 3, the lid 4A has the same shape as the base 4B. The lid 4A also has a surface member 8A, two side walls 14A and 16A, first and second outwardly extending rims 18A and 22A, a female recess 20A, and a male protrusion 24A. To avoid being redundant, the lid 4A will not be described further. When identical lid 4A and base 4B components are joined together, the female recesses, 20A and 20B, accept the male protrusions, 24B and 24A, respectively. This forms a loose joint as described below.

As shown in FIG. 2, the base 4B has a pair of end portions 10B and 12B. The end portions 10B and 12B are for connecting the base 4B and the lid 4A together. A first end wall 26B slopes away from the surface member 8B and terminates in the first end portion 10B. A second end wall 28B slopes away from the surface member 8B and terminates in the second end portion 12B. The first and second end portions, 10B and 12B, are identical.

Shown in FIG. 4 is the first end portion 10B. The first end portion 10B has a lower recessed area 30B adjacent the female recess 20B. An upper recessed area 32B is adjacent the lower recessed area 30B. The upper recessed area 32B is in the middle of the first end portion 10B. A protruding nub 34B is between the male protrusion 24B and a projecting plateau 36B. The plateau 36B extends from the nub 34B to the middle of the first end portion 10B. A lip 38B is attached to the plateau 36B. The lip 38B hangs over the upper recessed area 32B. The lip 38B is for connecting the lid 4A and base 4B components together, as explained below.

The second end portion 12B is identical to the first end portion 10B. The second end portion 12B will not be described further to avoid being redundant. As shown in FIGS. 1 and 2, attached to the second end portion 12B is a generally flat, rectangular planar extension 40B. The planar extension 40B has a hole 42B in it for hanging the container 2 on display or storing the components 4A and 4B.

The lid 4A and base 4B are identically shaped. However, the lid 4A and base 4B may be made out of different plastic. In one embodiment, the lid 4A is a clear or translucent plastic and the base 4B is opaque. This preferred embodiment works well for displaying the contents of the container 2.

Operation of the flower container 2 will now be described. The first step is to place the flower(s) in the base 4B. The lid 4A is then aligned with the base 4B as shown in FIG. 5 so that the ends 10A and 12A of the lid are in face to face registration with the ends 10B and 12B of the base, respectively. Given this registration, the nubs 34B of the base are aligned with the lower recessed areas 30A of the lid 4A and the nubs 34A of the lid 4A are aligned with the lower recessed areas 30B of the base 4B. At this point, the overhanging lips 38B of the base 4B interfere with the overhanging lips 38A of the lid 4A. To force the lips, 38A and 38B, past one another, pressure is applied simultaneously to the upper recessed area 32A on each end 10A and 12A of the lid 4A and the upper recessed area 32B on each end 10B and 12B of the base 4B.

As shown in FIG. 6, the lips, 38A and 38B, are forced past one another to latch. When so latched, lips 38A and 38B on each end of the container lock together and hold the lid 4A and base 4B together. The nubs 34B slide against the lower recessed areas 30A. The projecting plateaus 36B slide against the upper recessed areas 32A. At the same time, the nubs 34A slide against the lower recessed areas 30B and the projecting plateaus 36A slide against the upper recessed areas 32B. When the base first and second end portions, 10B and 12B, are connected to the lid first and second end portions, 10A and 12A, respectively, the container 2 is closed. To open the container 2, the lid 4A and base 4B are pulled apart at the ends. This forces the lips 38A and 38B on opposing components past one another.

As shown in FIG. 3, in the closed position, the male protrusion 24B along the second outwardly extending rim 22B fits into the female recess 20A in the first outwardly extending rim 18A. This forms a loose joint from one end of the container to the other. In the same way, the male protrusion 24A along the second outwardly extending rim 22A fits into the female recess 20B in the first outwardly extending rim 18B. This forms a second loose joint from one end of the container to the other.

Ventilation of the closed container 2 occurs through the loose fitting joints aided by two enlarged slots 44B and 46B along the outer portion of the female recess 20B, FIGS. 2 and 3. The slots, 44B and 46B, allow air to flow between the inside and the outside of the container 2 through the loose joints. Opposite the slots, 44B and 46B, on the inside of the female recess 20B, are recess extensions 48B and 50B. These extensions keep the male protrusion 24A inside the female recess 20B. The lid 4A also has slots 44A and 46A with extensions 48A and 50A for ventilation and keeping the male protrusion 24B inside the female recess 20A.

As shown in FIGS. 1, 2 and 4, the lid 4A and base 4B have recessed areas and ridges for structural rigidity. The base 4B has an oblong recessed area 52B in the surface member 8B. The side walls, 14B and 16B, have ridges, 54B and 56B, that extend from one end portion 10B to the other end portion 12B. The planar extension 40B has a recessed area 58B. Identically disposed recessed areas and ridges are present in the lid 4A.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A container, comprising:

(a) a pair of elongated components each having a surface member, a pair of sidewalls integrally formed with and sloping away from the surface member, and a pair of end walls integrally formed with the surface member and the sidewalls and sloping away from the surface member, each end wall terminating in an end portion;

(b) a protruding nub on each end portion and each end portion having a lower recessed area, said nubs and lower recessed areas for aligning the end portions of said pair of elongated components in face-to-face relation; and (c) interlocking lips on the end portions, said interlocking lips on opposing components latching to hold the components together in face-to-face registration so the elongated components cooperate to define a chamber.

2. The container of claim 1, wherein said elongated components are separable.

3. The container of claim 1, wherein said elongated components are interchangeable.

4. The container of claim 1, wherein said elongated components are molded plastic.

5. A flower container, comprising:

(a) a pair of elongated components each having a surface member, a pair of sidewalls integrally formed with and sloping away from the surface member and a pair of end walls integrally formed with the surface member and the sidewalls and sloping away from the surface member with each end wall terminating in an end portion, the pair of sidewalls and the pair of end walls disposed around the surface member to form an open side in each component;

(b) a protruding nub on each end portion and each end portion having a lower recessed area, said nubs and lower recessed areas for aligning the end portions of said pair of elongated components in face-to-face relation so the open sides of said elongated components face each other;

(c) interlocking lips on the end portions of said elongated components; and (d) means for joining the sidewalls of oppositely disposed elongated components in a mating relationship to form a loose joint.

6. The container of claim 5, wherein said means for joining the sidewalls of oppositely disposed elongated components comprises one of the sidewalls in each component terminating in a rim having a female recess and the other sidewall of each component terminating in a rim having a male protrusion, the female recess of one component mating with the male protrusion of the other component when said elongated components are in face-to-face relation.

7. The container of claim 5, wherein said elongated components are separable.

8. The container of claim 5, wherein said elongated components are interchangeable.

9. The container of claim 5, wherein said elongated components are molded plastic.

10. The container of claim 1, wherein said interlocking lips on opposing end portions are identical to one another.

11. A container, comprising:

(a) a pair of elongated components each having a surface member, a pair of sidewalls integrally formed with and sloping away from the surface member, and a pair of end walls integrally formed with the surface member and the sidewalls and sloping away from the surface member, each end wall terminating in an end portion;

(b) means for aligning the end portions of said pair of elongated components in face-to-face relation, said means for aligning comprising a protruding nub on each end portion and each end portion having a lower recessed area; and (c) identical interlocking lips on opposing end portions latching to hold said pair of elongated components together to define a chamber.

* * * * *